US005794573A

United States Patent [19]

Sunley

[11] Patent Number: 5,794,573

[45] Date of Patent: Aug. 18, 1998

[54] INTERNAL COMBUSTION ENGINE

[76] Inventor: Clarence Lavern Sunley, Box 1254, Esterhazy Saskatchenwan, Canada, S0A 0X0

[21] Appl. No.: 699,806

[22] Filed: Aug. 19, 1996

[51] Int. Cl.[6] ..... F02B 53/00; F02M 57/06

[52] U.S. Cl. ..... 123/18 R

[58] Field of Search ..... 123/18 R, 18 A

[56] References Cited

U.S. PATENT DOCUMENTS

| | | | |
|---|---|---|---|
| 1,216,160 | 2/1917 | Paige | 123/43 R |
| 1,285,835 | 11/1918 | Sunderman | 123/43 R |
| 1,423,395 | 7/1922 | Brown | 123/44 B |
| 3,299,867 | 1/1967 | Ficsur et al. | 123/18 R |
| 3,451,382 | 6/1969 | Huff | 123/18 R |
| 3,974,801 | 8/1976 | Brown | 123/18 R |
| 4,344,288 | 8/1982 | Heaton | 60/595 |
| 5,074,253 | 12/1991 | Dettwiler | 123/18 R |
| 5,203,287 | 4/1993 | Wiley | 123/18 R |

FOREIGN PATENT DOCUMENTS

| | | | |
|---|---|---|---|
| 526381 | 10/1921 | France | 123/18 R |
| 2617905 | 1/1989 | France | 123/18 R |
| 3725277 | 2/1989 | Germany | 123/18 R |
| 422337 | 1/1947 | Italy | 123/18 R |
| 2006612 | 1/1994 | U.S.S.R. | 123/18 R |

*Primary Examiner*—David A. Okonsky
*Attorney, Agent, or Firm*—Murray E. Thrift; Adrian D. Battison

[57] ABSTRACT

An internal combustion engine has an annular engine chamber in which a set of pistons oscillate in synchronism. On their compression stroke, the pistons draw in a fresh charge into the chamber behind the piston. On the power stroke, that charge is compressed and released into the next following combustion chamber. The engine geometry is selected to provide a a compression stroke that is shorter in duration than the combustion stroke.

12 Claims, 7 Drawing Sheets

INTERNAL COMBUSTION ENGINE

FIELD OF THE INVENTION

The present invention relates to internal combustion engines and more particularly to an oscillating piston type of internal combustion engine.

BACKGROUND

The most common form of internal combustion engine now available is a reciprocating piston engine with the pistons arranged in one or two banks of aligned cylinders. The reciprocating motion of the pistons is translated into rotary motion with a crankshaft and connecting rod linkage. Engines of this type are known to have significant limitations on their efficiency owing to their mechanical construction.

The sizes and shapes of the known engines are also limited by their in-line cylinder bank arrangement. The present invention is concerned with a novel form of internal combustion engine.

SUMMARY

According to the present invention there is provided an internal combustion engine comprising:

- a housing defining an annular engine chamber;
- a plurality of pistons spaced around the engine chamber and extending thereacross;
- drive means coupled to the pistons for simultaneously reciprocating the pistons along respective segments of the annular engine chamber;
- a plurality of charging valves in the annular engine chamber between respective pairs of the pistons and, with the pistons, dividing the annular engine chamber into alternating charging and combustion chambers around the engine chamber, the charging valves permitting gas flow only from a charging chamber to an adjacent combustion chamber and each piston substantially preventing gas flow between the charging and combustion chambers on opposite sides of the piston;
- intake means for admitting combustion air into the charging chambers with movement of the pistons into the combustion chambers; and
- exhaust means for exhausting combustion gases from the combustion chambers with movement of the pistons into the charge chambers.

The pistons thus oscillate in an annular chamber so that the engine can be made in a relatively compact configuration. In operation, on each compression stroke, the piston draws a volume of air-fuel mixture into the charging chamber behind it so that on the next power stroke, this air-fuel mixture is compressed and then injected into the adjacent combustion chamber through the charging valve to provide a supercharging effect.

The pistons are preferably mounted on a common impeller assembly. The oscillating motion of this impeller assembly is converted to rotary motion by a connecting rod and crankshaft assembly. The connecting rod is connected at one end to a crank throw of the crankshaft and at the other to a wrist pin on the impeller assembly. The crankshaft is eccentrically mounted with respect to the center of the engine chamber about which the impeller oscillates, and the connecting rod is longer than the maximum distance radially of the engine chamber between the crank throw and the circle containing the arcuate path of the wrist pin. This results in a shorter arc of rotation of the crankshaft over the compression stroke than over the expansion or power stroke, so that the power stroke is of longer duration, reducing the idle time between the power strokes and improving the combustion efficiency of the engine. The relatively long moment arm between the pistons and the center of the engine chamber, greater than the wrist pin to engine center distance, produces a relatively high torque output.

The engine can be constructed with two crankshafts arranged to drive a common ring or sun gear with respective pinions. The engine can be expanded to include additional engine chambers and impellers. In this case, the crankshaft has an additional throw for connection to each additional impeller with an appropriate connecting rod.

BRIEF DESCRIPTION OF THE DRAWINGS

In the accompanying drawings, which illustrate an exemplary embodiment of the present invention.

DETAILED DESCRIPTION

Figure 3:
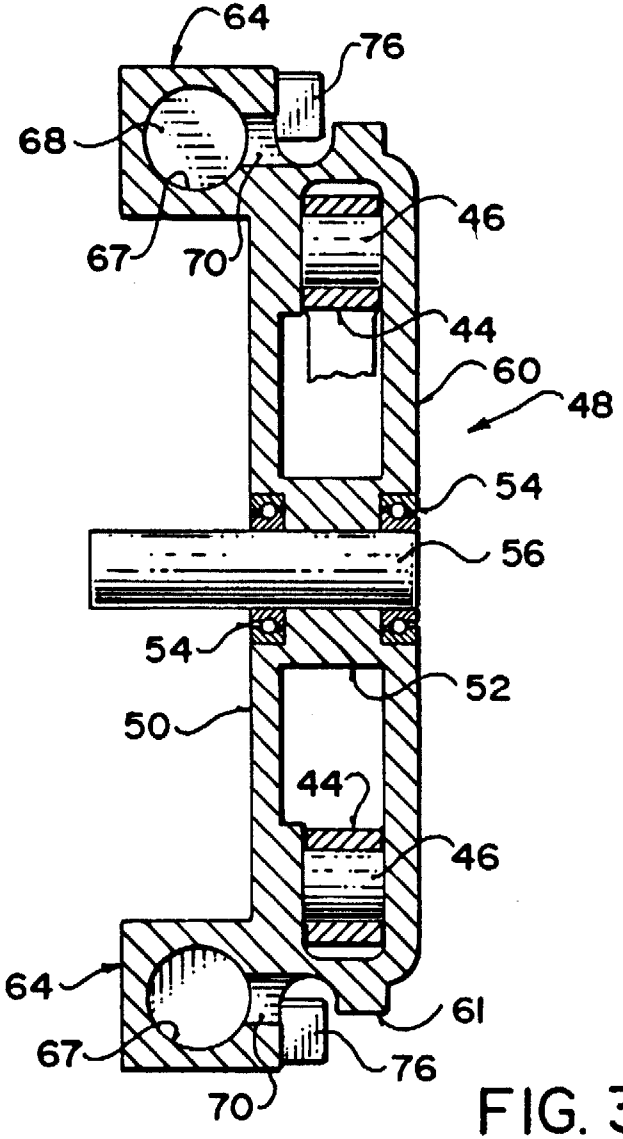
FIG. 3 is a cross-section through the center of the impeller unit, perpendicular to the section of FIG. 2.
Figure 1:
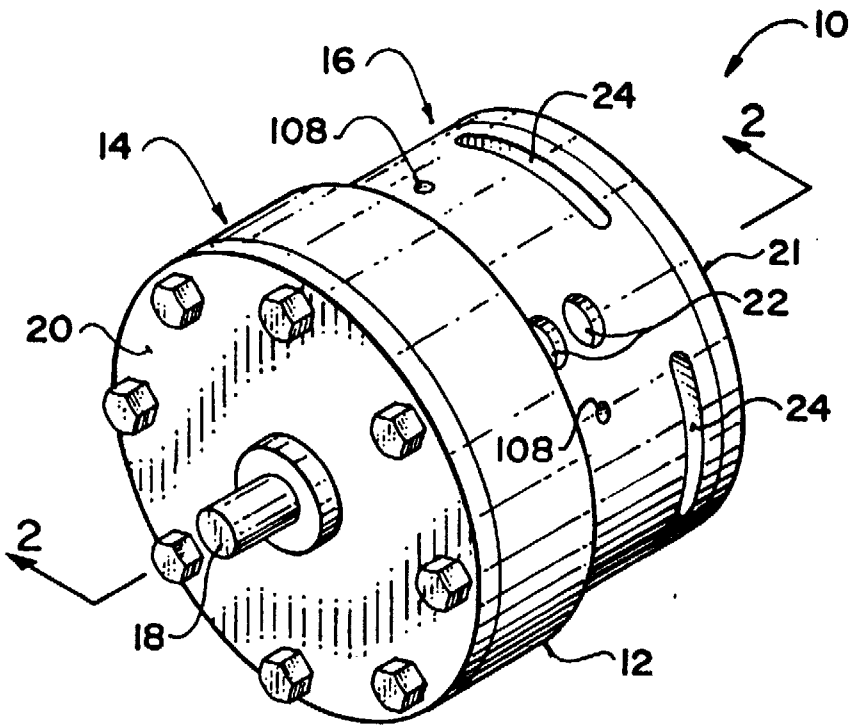
FIG. 1 is an isometric view of an engine according to the present invention.

Referring to the accompanying drawings, there is illustrated an engine 10 with a housing 12 with a stepped, cylindrical shape. The housing has a transmission end 14 that is somewhat larger in diameter than the opposite drive end 16. The engine drive shaft 18 projects from the center of the transmission end.

Figure 2:
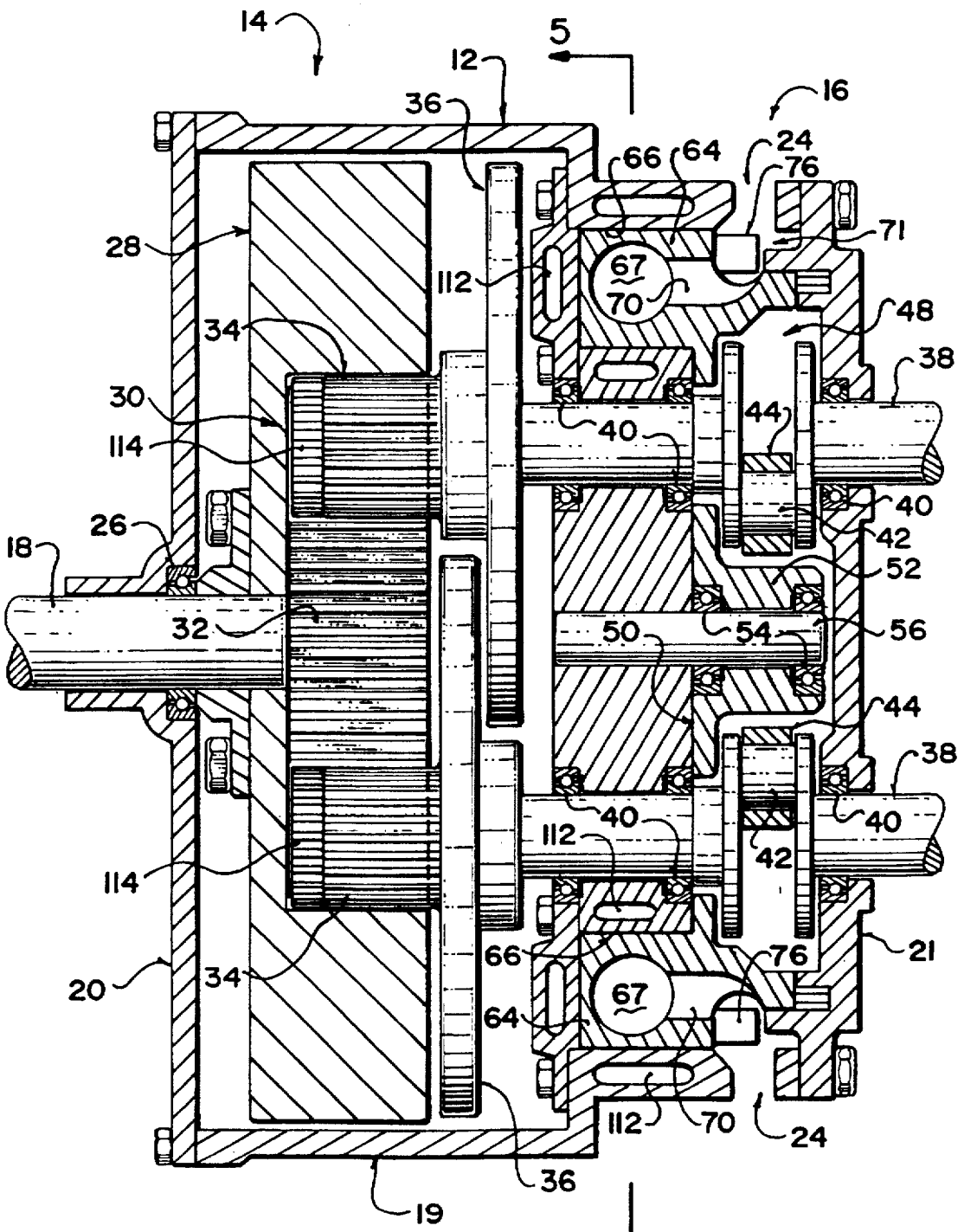
FIG. 2 is a section along line 2—2 of FIG. 1.
Figure 4:
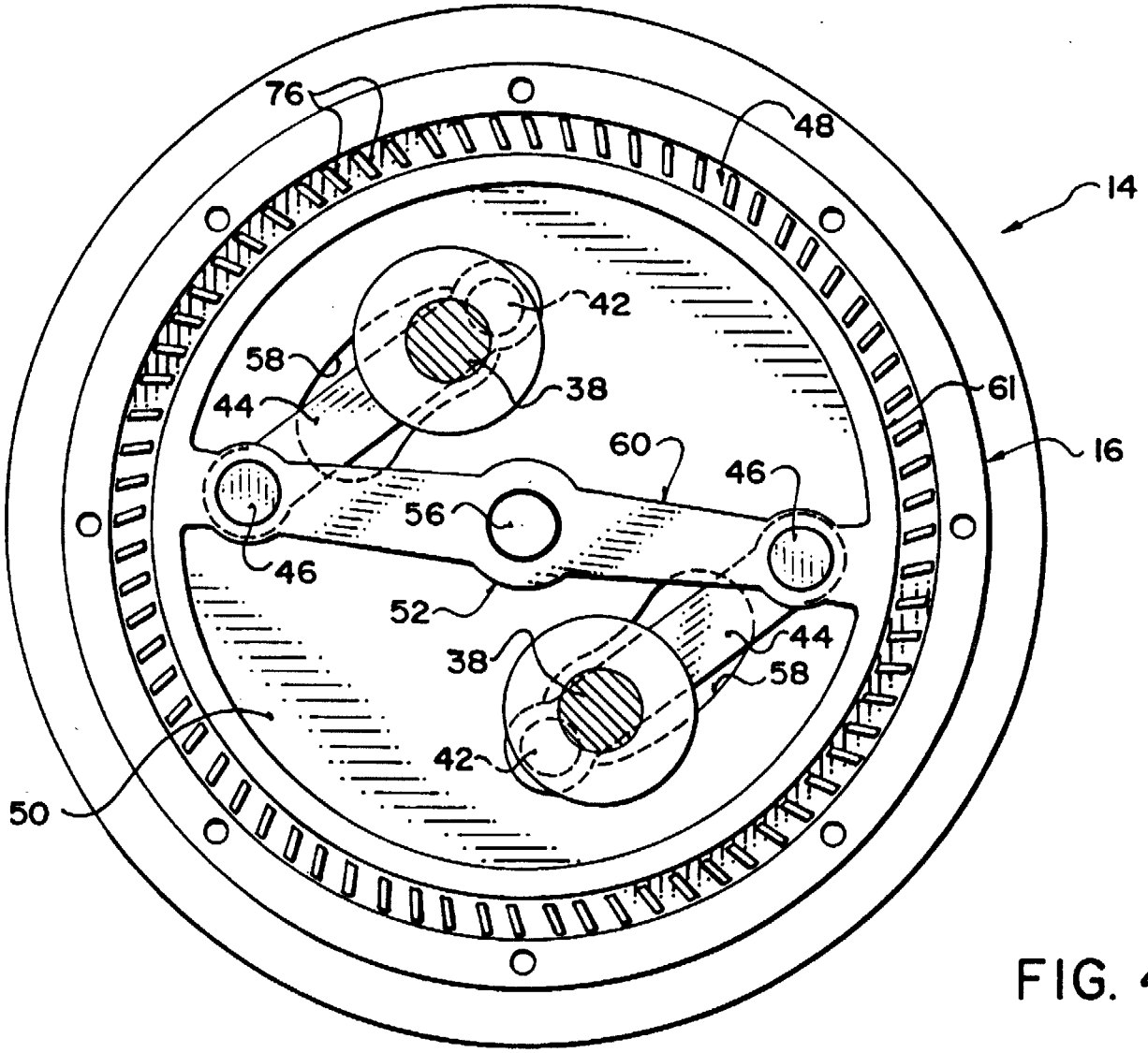
FIG. 4 is an end view of the unit with the end cover removed.
Figure 5:
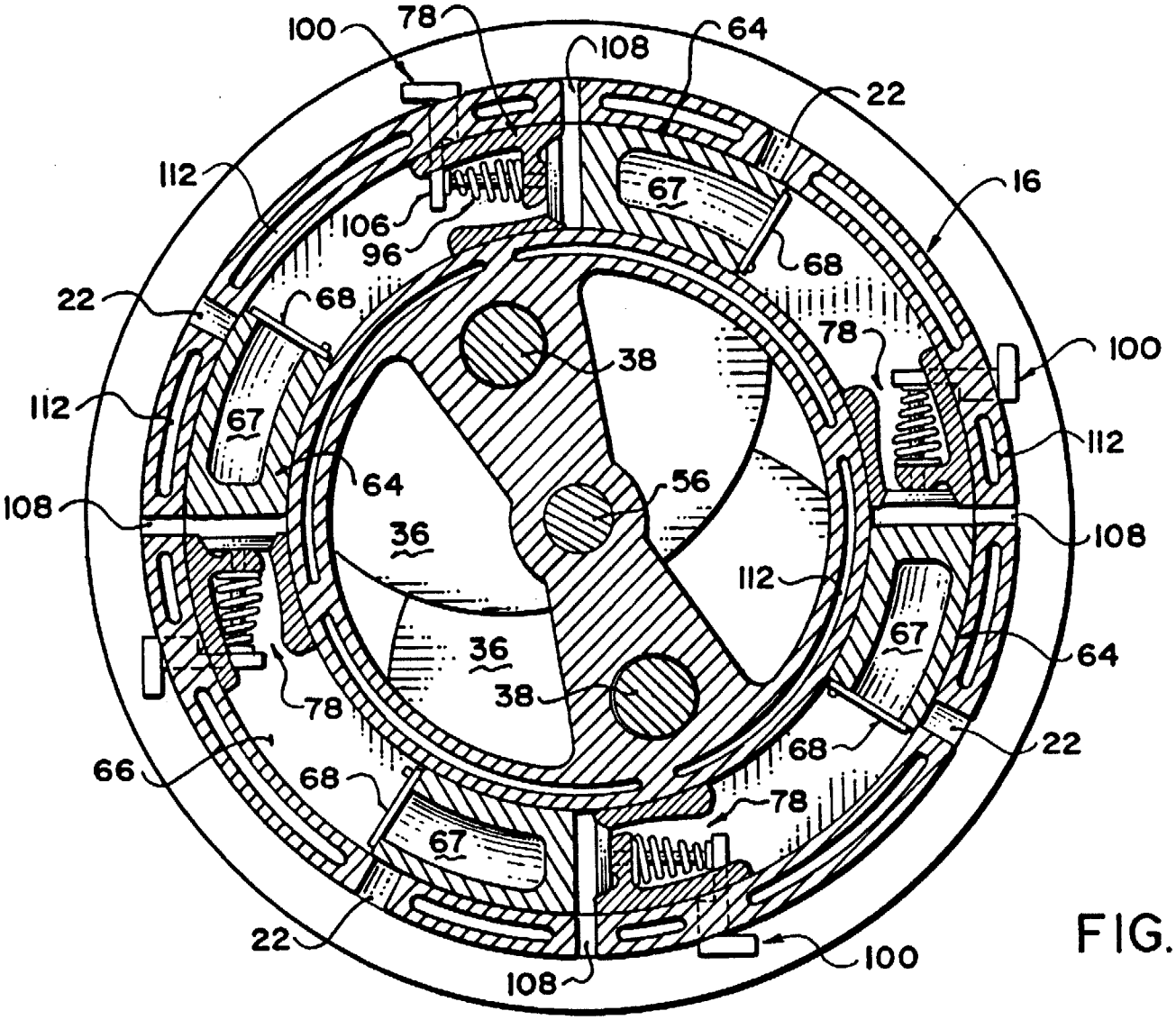
FIG. 5 is a section along line 5—5 of FIG. 2.
Figure 6:
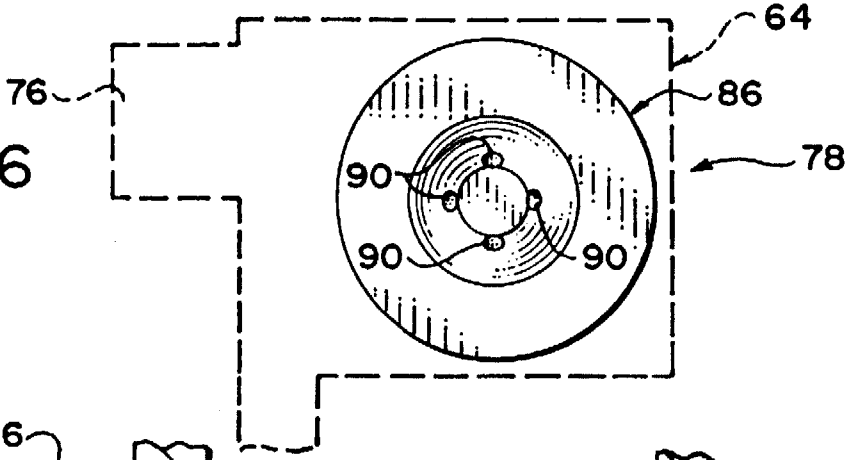
FIG. 6 is a detail end view of a valve.
Figure 7:
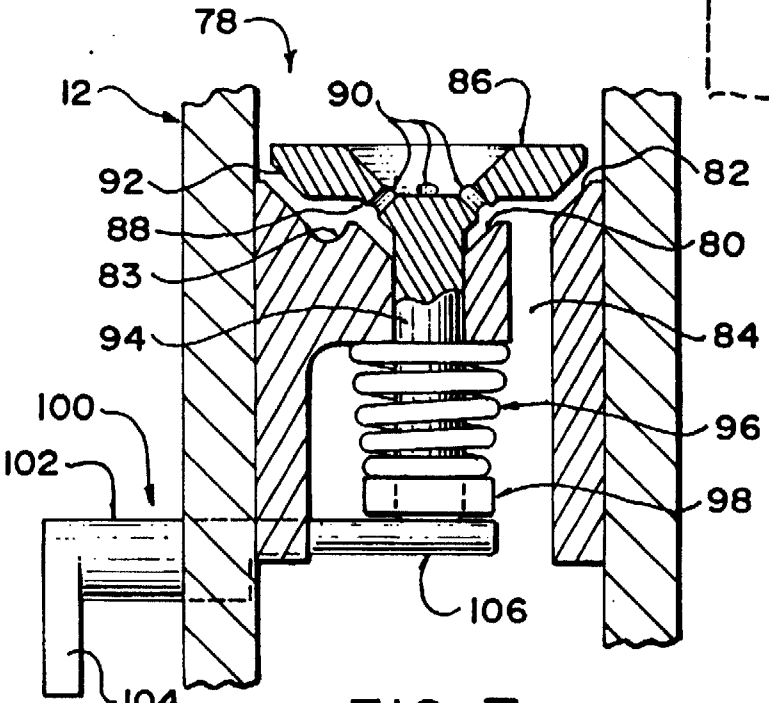
FIG. 7 is a longitudinal cross-section of the valve with the valve in an open condition.
Figure 8:
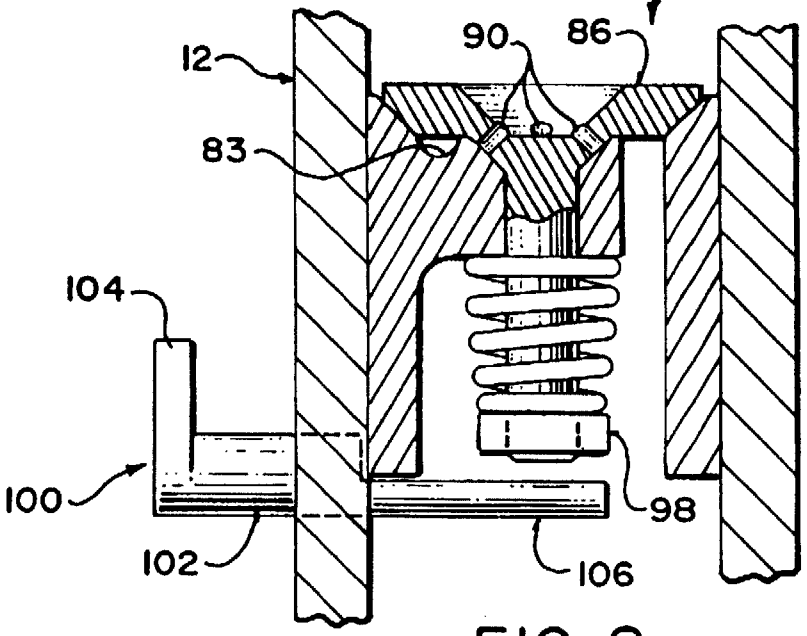
FIG. 8 is a view like FIG. 7 showing the valve closed.

As shown most particularly in FIG. 2, the housing 12 has an annular peripheral wall 19 with two bolted on end covers 20 and 21. Exhaust ports 22 and intake ports 24 are formed in the peripheral wall at the drive end.

Inside the transmission end 14 of the housing, the drive shaft is supported on a shaft bearing 26 and carries a flywheel 28. The flywheel is coupled to a gear set 30 that includes a ring gear 32 mounted on the flywheel and two pinions 34 engaging the ring gear. Each pinion is itself mounted on a secondary flywheel 36 coupled to the end of a crankshaft 38. The two crankshafts thus operate in synchronism, with both driving the drive shaft 18. Each of the crankshafts 38 is mounted on the housing 12 with crankshaft bearings 40. The crankshaft has a crank throw 42 on which is journaled a connecting rod 44. The opposite end of the connecting rod is connected to a wrist pin 46 carried by an impeller unit 48.

The impeller unit includes a base plate 50 carrying a central hub 52. The hub is mounted by bearings 54 on a central shaft 56 mounted on the housing 12 and aligned with the drive shaft 18. The base plate includes two oblong openings 58 that accommodate the crankshafts 38. A cross member 60 extends across the impeller unit 48 from the hub to an annular wall 61 projecting from the base plate 50. The cross member and the base plate carry aligned wrist pin bushings (not shown) supporting the wrist pins 46. On the opposite side of the base plate 50 from the wall 61 and the cross member 60 are four pistons 64. These are seated in an annular engine chamber 66 formed in the housing 12. The chamber has an open side into which the pistons extend. This open side of the engine chamber is closed by the base plate 50 of the impeller.

Each of the pistons has a hollow core 67 opening at one end of the piston. The open end of the piston is closed by a flap valve 68. An opening 70 extending from the piston core 67, through the side of the piston 64, the base plate 50 and the annular wall 61, opens into an annular chamber 71 in the housing. The intake ports 24 in the housing wall 20 communicate with this chamber. The impeller base plate 50 and the pistons 64 are sealed to the housing with oil and compression seals to seal the engine chamber 66 on opposite sides of the piston. The base plate 50 carries a series of cooling fins 76 that project into the annular intake chamber 71.

Between the adjacent pistons 64, the engine chamber 66 is divided by charging valves 78. Each valve has two, spaced conical seats 80 and 82, with a chamber 83 between the two, communicating with four valve passages 84. The valving member 85 has a valve head 86 with an inner face 88 for engaging the inner seat 82. Four ports 90 extend through the valve head from the valve face 88 to be closed by the inner seat 82 when the valve is closed. The valve head has an outer valve face 92 that engages the outer seat 80. The valve stem 94 is supported in a valve bushing carried by the housing. The stem is surrounded by a coil spring 96 engaged between the valve supporting part of the housing and a spring seat 98 on the stem. The spring is selected to allow the valve to open in response to a predetermined pressure across the valve.

The valves may be selectively retained in an open position using a valve opener 100. The opener includes a shaft 102 that extends through the housing 12, perpendicular to the valve stem. The shaft carries a crank handle 104 outside of the housing and an eccentric pin 106 on the inside. The eccentric pin is positioned at the end of the valve stem, so that when the shaft 102 is rotated, the pin 106 will engage the end of the valve stem and lift the valve head off of its seats, to maintain the valve in an open position. This allows the associated combustion chamber to be idle.

The housing 12 has spark plug bores 108 threaded to receive conventional spark plugs. These are positioned adjacent the heads of valves 78. The housing 12 is equipped with coolant passages 112 for the circulation of engine coolant.

As shown most particularly in FIG. 2, the pinions 34 may be associated with additional backlash adjustment gears 114.

In operation of the engine, each piston 64 oscillates through a section of the engine chamber between two of the valves 78. That portion of the engine chamber between the stem end of a valve 78 and the adjacent piston is a charging chamber 116, while the portion of the engine chamber between the head 86 of a valve 78 and the adjacent piston is a combustion chamber 118. The flap valve 68 confronts the charging chamber. An air-fuel mixture is supplied to the intake ports 24 from any appropriate source, for example a carburetor.

Figure 9A:
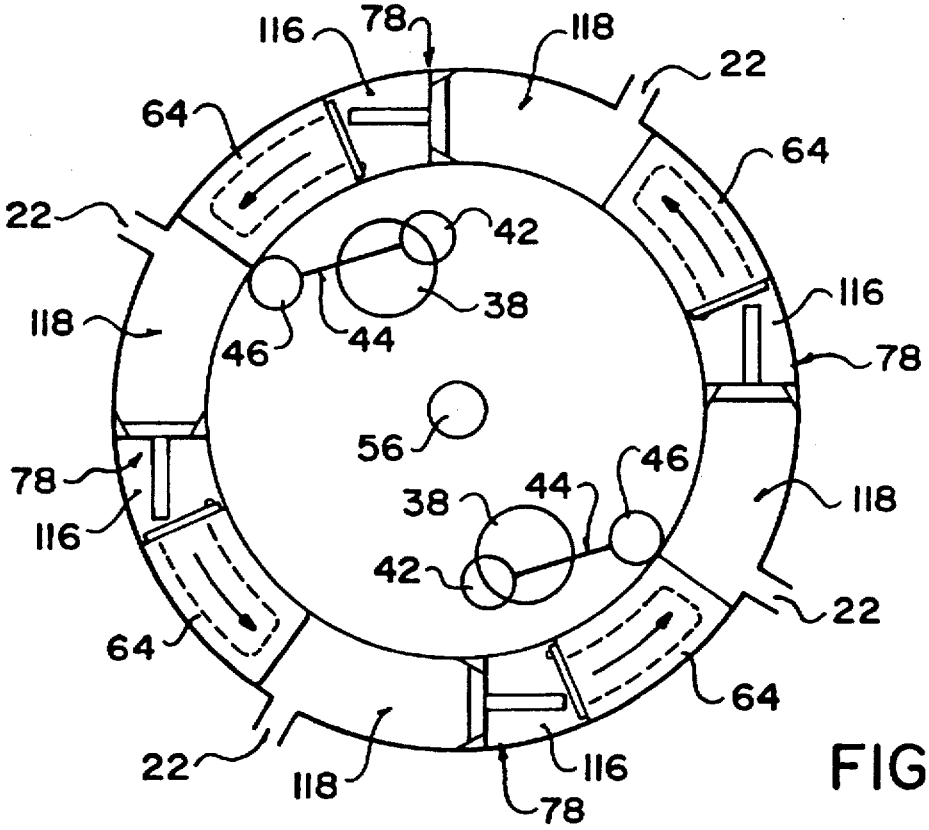
FIGS. 9*a*, 9*b*, 9*c* and 9*d* are schematic views showing the operating cycle of the engine.
Figure 9B:
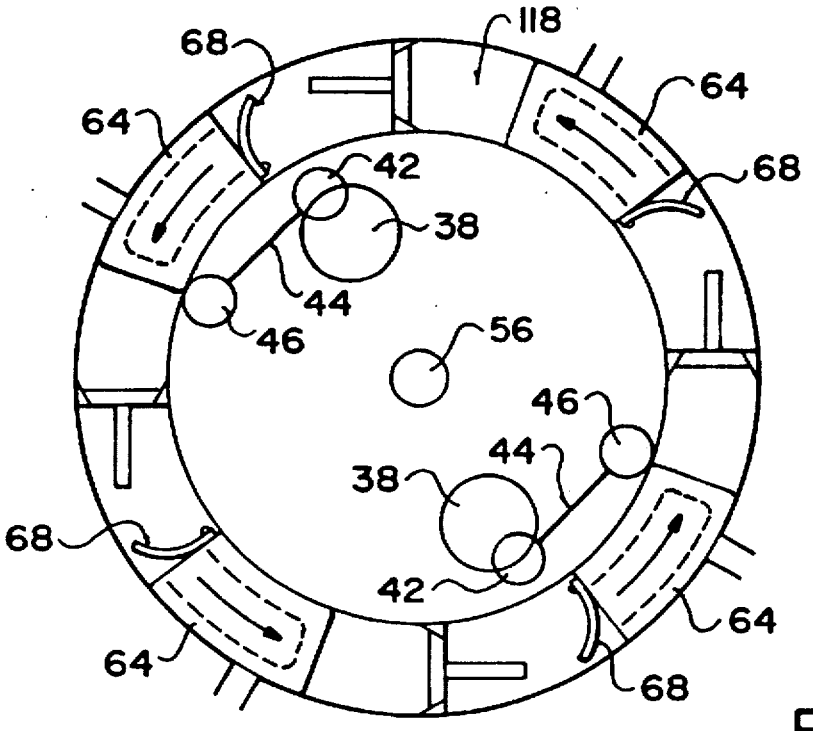
Figure 9C:
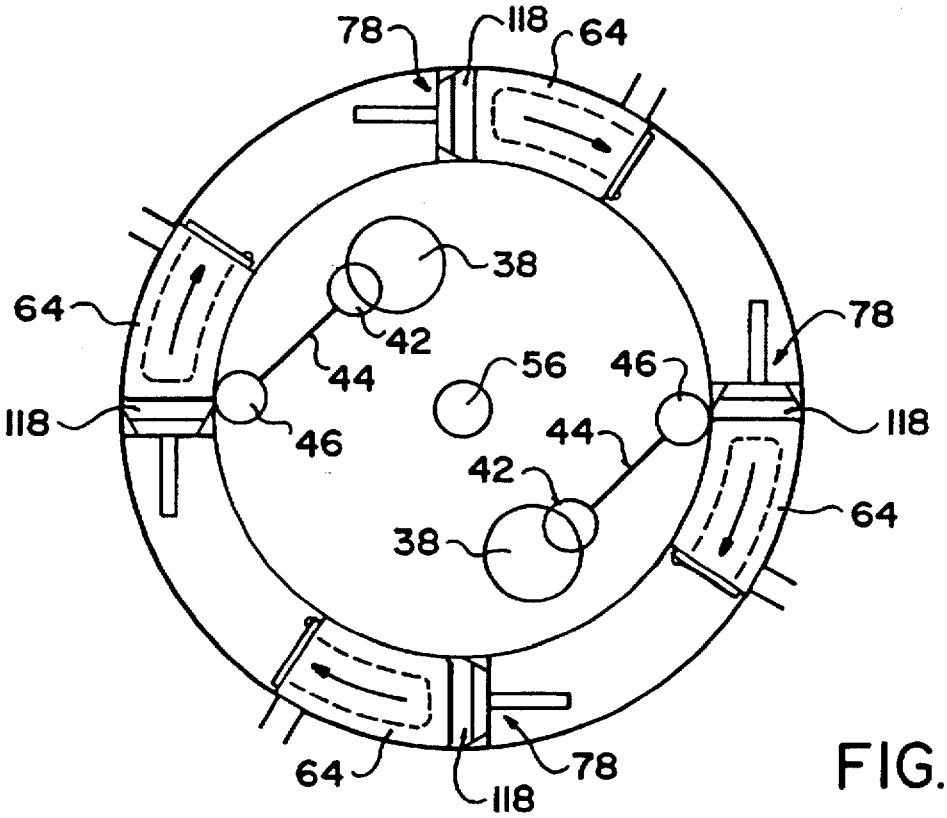
Figure 9D:
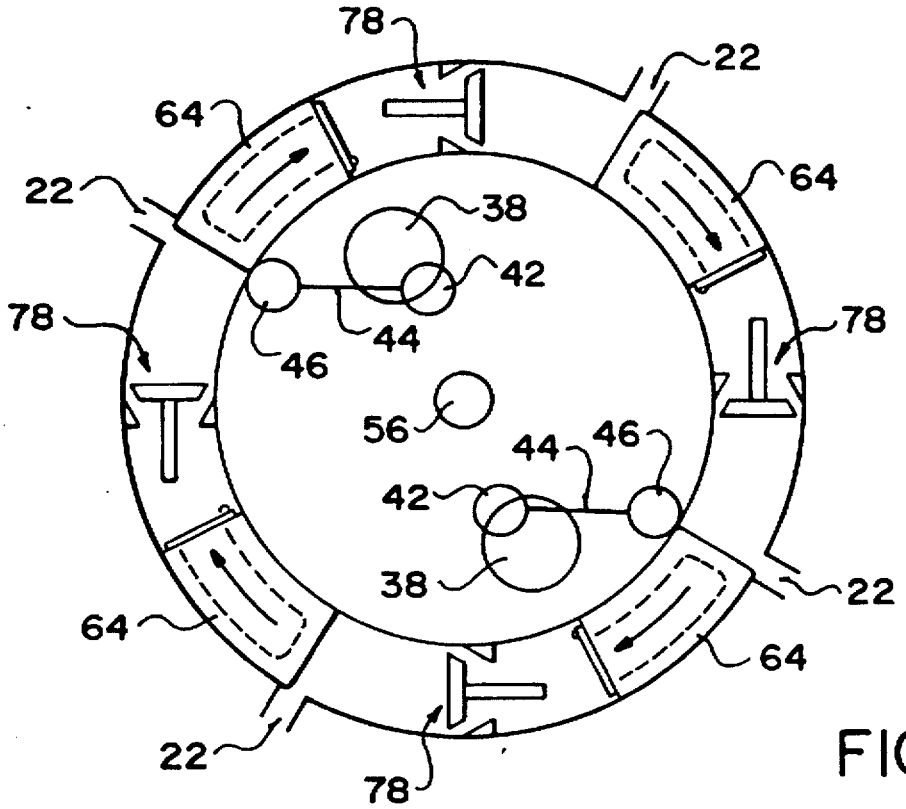

In the end position illustrated in FIG. 9*a*, the pistons are beginning an intake and compression stroke. The exhaust ports are open. As the piston travels along the chamber from the position shown at FIG. 9*a*, air-fuel mixture is drawn into the charging chamber through the intake ports 24, inlets 70, the hollow core 67 of the piston and the flap valve 68. After a short travel, the piston passes and closes the exhaust ports 22 and air-fuel mixture in the combustion chamber 118 is compressed until the piston reaches the end of its travel. At or near this point, the compressed air-fuel mixture is ignited and the piston is driven back along the engine chamber. This closes the flap valve 68, capturing the charge of air and fuel in the charging chamber. Travel of the piston along the chamber compresses the air-fuel mixture in the charging chamber 116. As the piston approaches its end position, the exhaust ports 22 are opened and the pressure in the charging chamber reaches a level sufficient to open the charging valve 78, allowing the compressed air-fuel mixture from the charging chamber to flow into the adjacent combustion chamber. The injected compressed air-fuel mixture scavenges the exhaust gases through the exhaust ports 22 and fills the combustion chamber with pre-compressed air-fuel mixture. The cycle is then repeated.

The oscillation of the pistons and the impeller unit as a whole, rotates the crankshafts 38 to drive the output shaft. The travel of the crankshaft throw is longer on the power stroke than on the return compression stroke. The connecting rod is longer than the maximum distance radially of the engine chamber between the crank throw and the circle containing the arcuate path of the wrist pin. As a result, the crank throw positions at the two end points of the piston travel are not opposite one another and the travel between those two points will be shorter in duration for the compression stroke than on the power stroke. This provides improved engine efficiency.

Additional piston units can be added to the engine by extending the housing to include two engine chambers, using crankshafts with two throws and adding another impeller unit. The crank throws on each crankshaft will be opposite one another so that the impeller units will oscillate in opposite directions to provide better balance.

The output speed and torque can be adjusted with the gearing between the crankshafts and the flywheel. In one embodiment, the ring gear may be replaced with a center, sun gear mounted on the output shaft between the gears on the crankshafts.

While the illustrated embodiment of the invention has been described as having four pistons, other numbers of pistons can be used as well.

While one embodiment of the present invention has been described in the foregoing, it is to be understood that other embodiments are possible within the scope of the invention. The invention is to be considered limited solely by the scope of the appended claims.

I claim:

1. An internal combustion engine comprising:

a housing defining an annular engine chamber;

a plurality of pistons spaced around the engine chamber and extending thereacross;

drive means coupled to the pistons for simultaneously reciprocating the pistons along respective segments of the annular engine chamber;

a plurality of charging valves in the annular engine chamber between respective pairs of the pistons and, with the pistons, dividing the annular engine chamber into alternating charging and combustion chambers around the engine chamber, the charging valves permitting gas flow only from a charging chamber to an adjacent combustion chamber and each piston substantially preventing gas flow between the charging and combustion chambers on opposite sides of the piston;

intake means for admitting combustion air into the charging chambers with movement of the pistons into the combustion chambers; and exhaust means for exhausting combustion gases from the combustion chambers with movement of the pistons into the charge chambers.

2. An engine according to claim 1 wherein each charging valve is spring-loaded to open under a predetermined pressure differential between the associated charging and combustion chambers.

3. An engine according to claim 2 wherein the intake means comprise an intake passage in each piston and valve means closing the passage in response to an air pressure in the charging chamber greater than an air pressure in the intake passage.

4. An engine according to claim 3 wherein the exhaust means comprise scavenging ports in the combustion chamber.

5. An engine according to claim 1 wherein the drive means comprise a crank having an axis of rotation and an eccentric crank throw, a connecting rod coupled to the crank throw and a wrist pin connecting the connecting rod to the pistons.

6. An engine according to claim 5 wherein the connecting rod is longer than the maximum distance radially of the engine chamber from the crank throw to a circle containing the path of travel of the wrist pin.

7. An engine according to claim 1 including means for selectively holding each of the charging valves open.

8. An engine according to claim 1 wherein each charging valve comprises concentric inner and outer valve seats, a chamber between the seats and plural apertures leading to the chamber, and a valving member including a valving head adapted to a seat on the inner and outer valve seats in a closed position of the valve and a plurality of ports through the valve head, closed by the inner seat in the closed position of the valve.

9. An engine according to claim 1 having an impeller assembly including the pistons and an annular plate on which the pistons are mounted.

10. An engine according to claim 9 wherein the plate closes one side of the engine chamber.

11. An engine according to claim 5 wherein the radial distance from the center of the engine chamber to each piston is greater than the radial distance from the center of the engine chamber to the wrist pin.

12. An engine according to claim 9 including a plurality of annular engine chambers and a plurality of piston assemblies coupled to respective crank throws arranged at an angle to one another about the crank axis.

* * * * *